US005249506A

United States Patent [19]

Willimczik

[11] Patent Number: 5,249,506

[45] Date of Patent: Oct. 5, 1993

[54] ROTARY PISTON MACHINES WITH A WEAR-RESISTANT DRIVING MECHANISM

[76] Inventor: Wolfhart Willimczik, 1406 63rd St. W., Brandenton, Fla. 34200

[21] Appl. No.: 832,381

[22] Filed: Feb. 7, 1992

Related U.S. Application Data

[63] Continuation-in-part of Ser. No. 493,901, Mar. 15, 1990, abandoned.

[51] Int. Cl.[5] ..... F01B 3/00

[52] U.S. Cl. ..... 91/499; 92/57; 417/462

[58] Field of Search ..... 417/269, 271, 462, 466; 91/499, 503; 92/71, 57

[56] References Cited

U.S. PATENT DOCUMENTS

| | | | |
|---|---|---|---|
| 1,483,198 | 2/1924 | Schinkez | 91/503 |
| 2,096,907 | 10/1937 | Linderman | 91/503 |
| 4,771,676 | 9/1988 | Matsumoto et al. | 91/499 |
| 4,776,257 | 10/1988 | Hansen | 92/57 |
| 4,788,902 | 12/1988 | Akasaka et al. | 92/57 |
| 4,800,801 | 1/1989 | van Zweeden | 417/269 |
| 4,801,249 | 1/1989 | Kakizawa | 417/269 |
| 5,070,765 | 12/1991 | Parsons | 417/269 |

*Primary Examiner*—Richard A. Bertsch
*Assistant Examiner*—Michael I. Kocharov
*Attorney, Agent, or Firm*—Richard Litman

[57] ABSTRACT

A new kind of rotary piston machine with sealed work chambers and a wear resistant driving mechanism. Pivotal pistons move within respective cylinders and both the pistons and the cylinders revolve about circular orbits which are relative to one another. Both pistons and cylinders are included in a single piece rotor of unitary construction and can have either an axial or a radial configuration. Single-cylinder or multi-cylinder engines are included. This invention eliminates the necessity of piston bearings and thus, provides a wear-resistant, oil-free, driving mechanism. This invention further unites the sealing performance of the classical piston machine with the kinematic qualities of the rotary system. The solution is found through a suitable kinematic configuration providing mobility between the pistons and the cylinders which is crosswise to the stroke motion of the piston and is achieved through the use of crosswise elastic piston rods or other crosswise movable power transmission parts, excluding glidable or slidable parts, such as bearings. In a single cylinder machine, the piston is simply fastened rigidly to the shaft. This invention provides an oil-free displacement configuration useful in machines such as compressors, air motors, pumps, water-hydraulic motors, engines and the like.

19 Claims, 4 Drawing Sheets

ROTARY PISTON MACHINES WITH A WEAR-RESISTANT DRIVING MECHANISM

CROSS-REFERENCE TO RELATED APPLICATION

This application is a Continuation-In-Part of application Ser. No. 07/493,901, filed Mar. 15, 1990 now abandoned.

BACKGROUND OF THE INVENTION

1. Field of the Invention

The invention relates generally to a rotary assembly unit, and more particularly, to a rotary piston displacing machine having a piston rotor comprising a rotatable set of pistons and a respective cylinder drum comprising a rotatable set of cylinders. The rotor and the drum are interengaged, each having a different but related rotating axes. The axes may be in any configuration, that is axial or radial. This rotary piston machine is a displacement machine having sealed work chambers. It uses a relative stroke motion in a rotating system. This kind of machine is identified by a wear-resistant power transmission which does not require bearings or a lubricant. This machine configuration may be applied to oil-free pumps, oil-free compressors, water hydraulic motors and combinations thereof as well as processing machines having flowing medians of varying capacity. The function of this machine will not be restricted by use of necessary elastic wall parts for the work chamber.

2. Description of Prior Art

A number of similar designs for rotary piston machines are known, particularly axial and radial piston pumps and compressors, as well as oil hydraulic motors, each having numerous bearings between the piston and the drive shaft. Such designs incorporating piston bearings necessitate the use of oil.

A problem with known rotary piston machine designs is that the center of each of piston strives to leave the axis of symmetry of each respective cylinder because both the piston and the cylinder revolve within different yet relative orbits. This produces a substantial amount of friction which has formerly been compensated for through the use of piston bearings which eliminate unwanted crosswise movement of the piston relative to the axis of the cylinder.

So far, attempts to reduce friction have not been completely successful and have created other problems. Not one design delivers a good combination of the high sealing performance of the classical piston system, the advantages of the rotary principle, particularly the kinematic advantages, and the renunciation of piston bearings. These features, in combination, would produce new piston engines which do not require piston bearings as well as provide a bearing free driving mechanism which could convert relative stroke motion machines into a wear-resistant rotary type machine. A machine combining these features would be useful in a large field of oil-free applications, such as oil-free pumps, oil-free compressors, and in water hydraulics. This invention delivers not only a new piston engine free of piston bearings but delivers a bearing free driving mechanism for converting all types of relative stroke motion machines into a rotary type machine.

For purposes of clarification, the following terms and definitions hereafter are used in the subsequent description. Cylinders are understood to be moving working space walls which have a constant but arbitrary cross section along the length of the stroke. The cylinders may be open or closed at both ends. The "figure axis" of a cylinder represents the axis which extends along the axis of symmetry of the cylinder and has the length equal to the stroke of the piston. Pistons may be move in the cylinders in the stroke direction. Further, each piston occupies the cross-sectional area of its respective cylinder to provide a seal of the working space such that during a stroke of the piston, the piston seal sweeps along the cylinder wall. Spherical pistons may be ball-shaped or calotte-shell shaped. The center of each shape corresponds to the center of the piston represented. In the context of the description, relative stroke motion means that no pure stroke motion occurs in a system fixed in space and further refers in general to a linear stroke motion which is superimposed in a moving system by a common rotation in which the momentary axes of rotation are described by arbitrary three-dimensional curves. "Single-piece" means one piece or several pieces integrally joined together, either threadably attached, forged, or welded, but not joined by bearings or other glidable parts which are subject to wear. "Different but related axis" means a small angle, a small distance, or a combination thereof which can exist between both axes to create a short stroke length.

A theoretical problem exists as follows. There are always at least two rigid parts that create one work chamber, a piston and a cylinder. Both the piston and the cylinder revolve about separate but related orbits, both revolve in the same direction, and both revolve at the same number of revolutions per second. The piston and the respective cylinder revolve in such a manner that periodic changes occur in the distance between corresponding fixed points represented by the two revolving bodies. The length of the stroke motion is represented by the change in distance between corresponding fixed points.

An unwanted motion, for example, a tip over or a rock vertical to the stroke motion is present in existing machines which so far has been compensated for through the use of piston bearings. The tip over can be substantially eliminated through the use of pivotal pistons. The remaining motion perpendicular to the stroke motion can be substantially eliminated by allowing one of the work chamber parts to move lateral to the stroke motion thereof. In other words, one of the orbits must be corrected such that the center of each piston and its respective seal remain along the figure axis of each respective cylinder. The correction is necessary only vertical to the stroke vector because within a cylindrical coordinate system, every point of the space within reach through one coordinate with the second coordinate being vertical in any direction. Out of it follows that every correction can be made through a movement vertical to the stroke vector.

The abstract solution is that each piston or its respective cylinder must be movable vertical to the stroke motion. This theory is valid for every kind of piston machine wherein pistons and their respective cylinders revolve within neighboring orbits. With this in mind, it must be possible to create a machine free of piston bearings in any and every case. This is a fundamental concept. This method is applicable for any and every case because the configuration of the orbits and in particular, the angle between the vectors of the rotation are free and changeable between 0 degrees and 360 degrees, therefore encompass the whole circle. This is true for all rotating piston engines. It is irrelevant whether there is a driving or driven shaft or whether there are several shafts, whether the shafts rotate, circulate or wobble, whether the creation of the stroke is attained through slanted axial alignment, eccentricity, wobbling or through a combination thereof. Moreover, shape, number of moving parts and position of the axes of rotation are irrelevant. Also, the parts which rotate, that is either the pistons or the cylinders, and the parts which only turn or rest, and whether the momentary axes of rotation rotate or carry out an oscillating motion are all irrelevant. The momentary axes of rotation may be inclined or may extend parallel to each other as in a radial piston engine, may be fixed with respect to a body and fixed in space, or neither fixed with respect to a body nor fixed in space, or may carry out any motion. The most basic engine or machine, thus is of inclined axial alignment and has a certain eccentricity in the stroke area.

SUMMARY OF THE INVENTION

The present invention relates to a rotary machine which addresses the aforementioned problems associated with machines which presently require piston bearings by eliminating the piston bearings and thus, creating a wear-resistant driving mechanism. The most elegant way to substantially eliminate friction is to remove the piston bearing because the omition of a bearing is better than even use of the very best bearing, that is to say this would eliminate substantially the only piston element subject to wear and thus, provide a totally wear-resistant power transmission.

The wear-resistant power transmission is introduced according to the aforementioned background theory through the following combination of features. The first step is to minimize the amplitude of the unwanted movement crosswise to the stroke motion by a suitable configuration. This is a mathematics variation problem between both space curves and other characteristics of the rotary piston machine.

The physical intelligence of this invention makes it possible for every kind of rotary piston machine having respective piston and cylinder pairs to be suitably configured to produce very small elongated strives crosswise to the stroke movement. These crosswise strives can be substantially reduced, if not entirely eliminated. This is achieved simply by implementing power transmitting elements which move crosswise to the stroke motion. This is the mean result of the theory and will be reached under the following conditions. The orbits of the pistons and cylinders must be related or similar. To substantially eliminate the tip over, each of the pistons must be pivotal about their respective center. For a multi-cylinder machine, each piston must also be movable, one with respect to the others and at right angles to the stroke motion. The practical solution is as follows. The pivotal piston can be a flat disc with a flexible seal, can be spherical with or without a piston ring, or can be like a spherical bearing with a thin wall. For a single axial or radial machine, the piston can be connected rigidly to the shaft. For a multi-cylinder axial, oblique angled, or radial rotary piston machine, the pistons can be connected to a piston carrier by resilient shafts, such as flexible piston rods or poles, plates, sheets, torsion bars, leaf springs, ropes, or the like. The rods, in the stroke direction, are burdened preferentially by tractive force because pressure is only against one end of the piston. These rods are not elastic in the power transmission with respect to the stroke direction. Further, the flexible shafts are not overloaded because the amplitude of this oscillation is very small, for example much less than one degree. A piston rod can be a combination of numerous crosswise elastic elements. For example, a plurality of elongated tubular members, each having different diameters, each fitting concentrically one inside another, and joined together at alternate ends. These slender and bendable shafts are essentially subjected to tensile forces in a manner such as with bicycle spokes. In addition, these piston rods may be anchored via resilient elements to provide elasticity. For a very short stroke, it can be sufficient to use only flexible seals or laterally movable piston rings on the pistons instead of using flexible piston rods. In the case of the single cylinder engine, the center of the pivotal piston remains automatically in the axis of symmetry of the cylinder due to the different angular speeds of each part. Therefore, the piston can be rigidly connected to the shaft. A single-cylinder engine is obtained by simply reducing a multi-cylinder engine to one cylinder. Suitably, the moving parts are situated closer to the center. It should be taken into consideration that the circular path of the piston center does not intersect an axis as this would constitute a dead center at which no torque can be transmitted and thus, prevent the engine from starting.

The control system can be correspondingly varied and may include only slots, valves, or a combination of slots and valves. concept of the present invention makes it possible to manufacture very large engines or very small engines, either of the single cylinder type or of the multi-cylinder type, regardless of the direction of the axis, and without the need of oil or lubrication.

The most basic machine within the scope of this variant is slanted and has an envelope of a cone as a control surface. The envelope of a cone or the envelope of a truncated cone changes, in either case, such that the angle of the cone changes into a circular plane, a circular ring-shaped plane, or a cylinder jacket. Either the axial piston engines or radial piston engines are borderline cases of a basically slanted piston engine.

The present invention can be used in virtually all rotary piston machines, either of the axial or radial piston type, and is suitable for all working processes which are based on the principle of displacement in which any mechanism, including hydraulic and pneumatic mechanisms, can be converted into each other.

Accordingly, it is the main objective of the present invention to unite the sealing performance of the classical reciprocating piston system with the harmonious kinematics of a rotary system, to provide a machine which possesses the oil-free attributes of a centrifugal system and more particularly, to create a wear-resistant driving mechanism for rotary piston machines, without losing other advantages offered by the rotary system design.

In particular, it is an object of the present invention to provide an improved piston engine, such as a rotary engine, a rotating engine, or a wobble piston engine, by converting a relative stroke motion system into a rotary system having an arbitrary arrangement of momentary axes of rotation. This is attainable without the use of any slidable or rollable piston bearings between the power transmitting parts. This improved piston engine generates a stroke movement which defines the working chamber.

This object and others which will become apparent hereinafter are attained in accordance with the present invention by selectively shifting of the pistons or piston seals transversely to the stroke motion so that the center of each piston is retained along the figure axis of each respective cylinder. A characteristic of this invention is the form-fitting, integral connection of the power transmitting elements with one another as well as with the shaft. This is accomplished without interposing any bearings between the pistons and the drive shaft and thus, without the need for a lubricant. A machine of this type provides uninterrupted power flow from the working space to the shaft, that is, without interruption through slidable or rollable parts.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
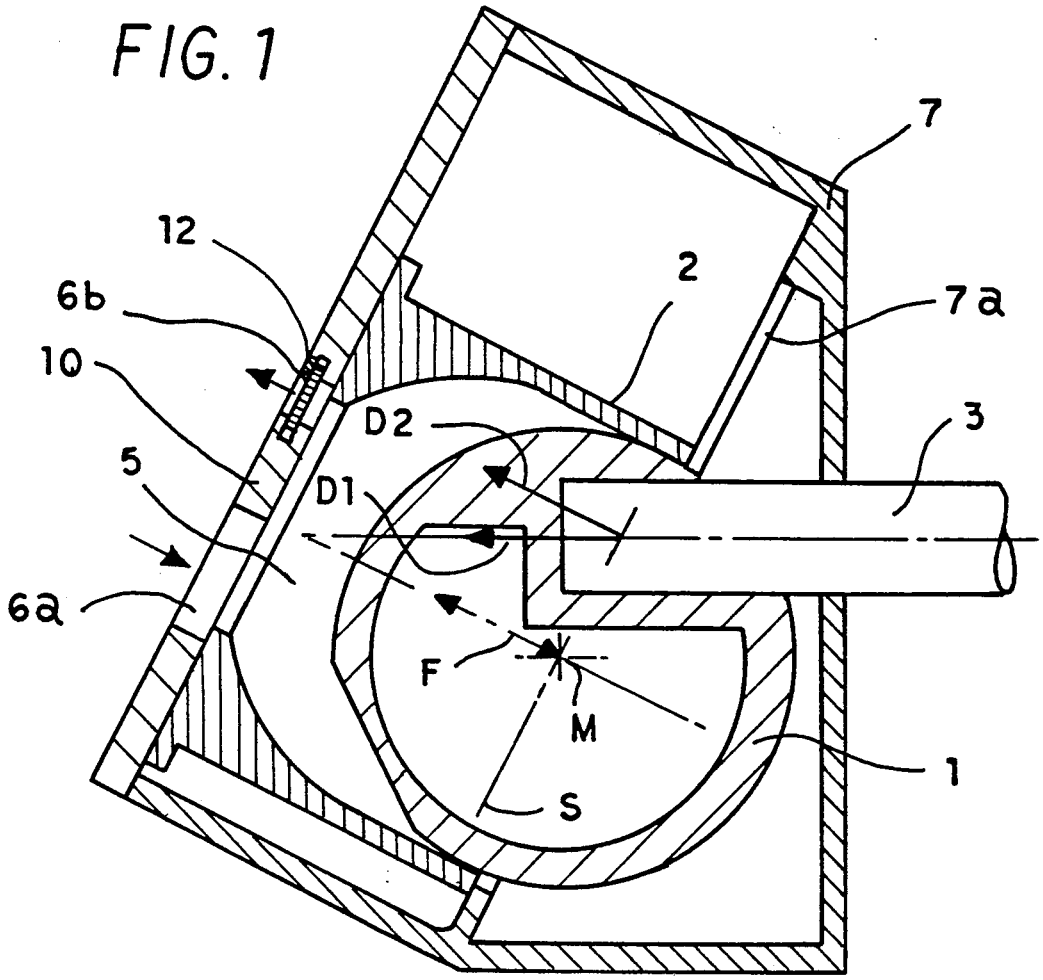
FIG. 1 is a sectional view of an axial single-cylinder machine in accordance with the present invention.

Referring now to FIG. 1, there is shown a sectional view of an axial single-cylinder engine having slanted axial alignment and having a certain eccentricity. The single-cylinder engine includes a spherical piston 1 which is accommodated in a loosely provided cylinder 2 and is eccentrically fixedly connected to a shaft 3. The piston 1 and the cylinder 2 define momentary axes of rotation D1 and D2 which extend at an acute angle with each other and lie outside the figure axis F of the cylinder 2 as well as outside of the center M of the piston 1. The drawing depicts the momentary axes of rotation D1 and D2 as vectors. According to the present invention, the driving mechanism includes a single piece, that is a piece of unitary construction, which contains the piston 1 and the drive shaft 3. There are no bearings between piston 1 and drive shaft 3. The inclination angle is easy to change depending on the capacity of the machine.

Figure 1A:
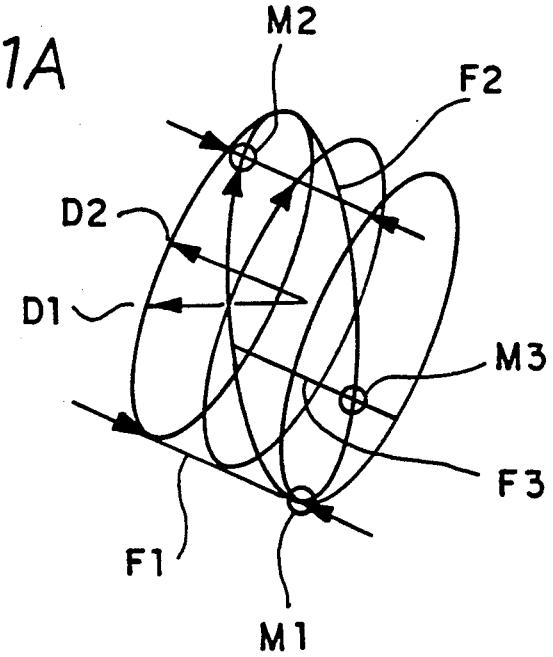
FIG. 1*a* is a vector diagram illustrating the overall kinematics of the rotary piston machine.

FIG. 1*a* shows a vector diagram depicting the overall kinematics of the single-cylinder engine of FIG. 1 in order to abstractly illustrate the direct correlation of the elements. This is necessary because with this abstraction, one can prove the uniformity of all examples. As can be seen therefrom, the center M of the piston 1 describes precisely a circular path which is characterized by the vector of the momentary axis of rotation D1 of the piston 1. The vector D1 is fixed in space, fixed with respect to a body, and coincides with the axis of the shaft 3. The vector of the momentary axis of rotation D2 of the cylinder 2 is neither fixed in space nor fixed with respect to a body but extends parallel to the figure axis F of the cylinder 2. Extending perpendicular to the figure axis F is the contact or sealing plane S as defined by the line of contact or sealing line between the piston 1 and the cylinder 2.

As shown in FIG. 1, the axis of shaft 3 and the vector D1 intersect the sealing plane S, and the vector D2 lies at this point of intersection. Since the contact plane S carries out a stroke within the cylinder 2, the vector D2 also follows this movement. Without this stroke motion, the three-dimensional curve of the figure axis F of the cylinder would be an elliptically deformed cylinder; with the stroke motion, the cylinder is additionally deformed, that is slantingly shifted. But it does not matter, because the cylinder 2 can freely slide along the slanting plane or flat control surface 10 of the casing 7 so that any given path in this plan is possibly guided by the piston 1. In a rotating body fixed system, the piston describes a wobbling motion in the cylinder. Thus, each inclined variant of the piston engine can be modified into a wobble piston engine.

In FIG. 1*a*, the circular path of the piston 1 or its center M are designated by a circle and the figure axis F of the cylinder 2, symbolized by a line, with the length of the line representing the length of the stroke. As is shown in FIG. 1*a*, with respect to three positions M1, M2, M3 of the center M and the pertaining positions F1, F2, F3 of the figure axis F, the figure axis F always intersects the center M of the piston 1. As is shown in FIG. 1*a*, both rotations of the piston 1 result in an oscillating motion of the piston 1 within the figure axis F of the cylinder 2. The figure axis F and the center M cover different distances so that one part, the piston for instance, has to adjust to the other part, the cylinder in this case. This is the basic principle for all embodiments of the present invention. This is simultaneously the proof for the theory.

The single-cylinder machine or displacement machine of FIG. 1 may serve as a small oil-free compressor or oil-free vacuum pump. The spherical piston 1 is fixedly and eccentrically secured to the shaft 3. In order to avoid any dead volume, the cylinder 2 is suitably turned out in a spherical shell shaped manner. The outlet port 6*b* is controlled by a check valve 12 and permanently communicates with the working space 5 through an opening in the cylinder 2 adjacent the control surface 10 of the casing 7. During compression, the control surface 10 causes the cylinder 2 to be pressed thereon. During induction, an outer sealing edge and the pressure within the casing 7, which generally corresponds through leakage almost to the conveying pressure, ensure a sufficient contact pressure of the cylinder 2 against the control surface 10. Thus, the cylinder 2 is prevented from lifting off the control surface 10 during normal operation. In case of disturbances, the cylinder 2 is, however, secured against falling out of the casing by an inwardly directed casing part 7*a*.

Figure 2:
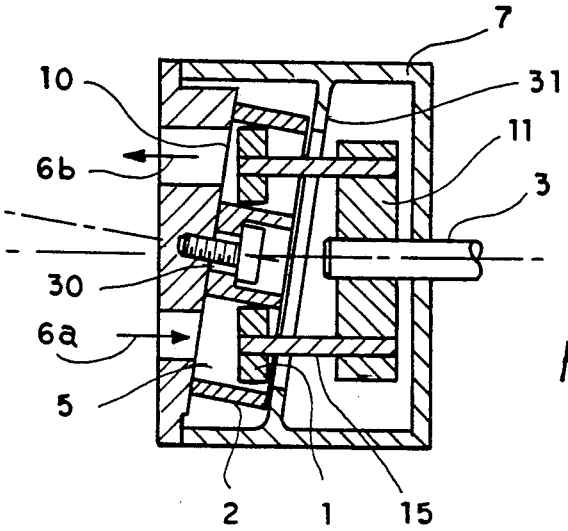
FIG. 2 is a sectional view of an axial piston engine in accordance with the present invention having crosswise elastic piston rods included in the driving mechanism.
Figure 2A:
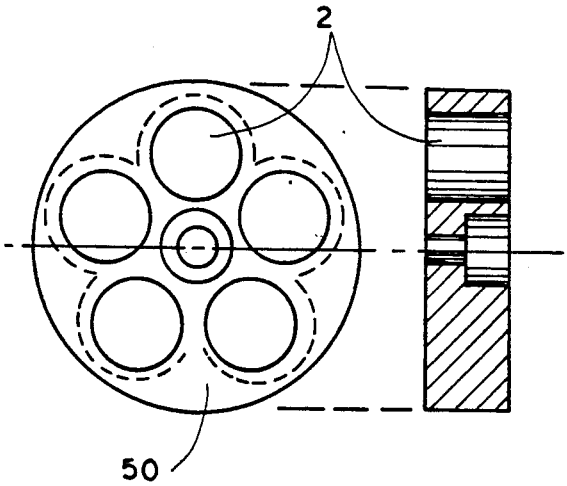
FIG. 2*a* is a plan view and a longitudinal sectional view of a cylinder drum of the axial piston engine of FIG. 2.

Turning now to FIG. 2*a*, there is shown a sectional view of an axial piston engine with several cylinders 2 which are accommodated by a rigid cylinder drum or cylinder block 50 (shown in FIG. 2*a*) slidable upon a slanted control surface 10 of casing 7. The slanted angle is about 5 degrees and easily changeable. operating with the cylinders 2 are spherical pistons 1 which are connected to a piston carrier 11 via elastic piston rods 15 which impart to the pistons 1 transverse elastic characteristics. The piston carrier 11 is securely mounted on the shaft 3. Basically, the cylinder drum can have a drive shaft as well. Whether the cylinder drum is a performance part depends on the kind of the piston seal used because the piston seal can change the flow of torque.

Figure 2B:
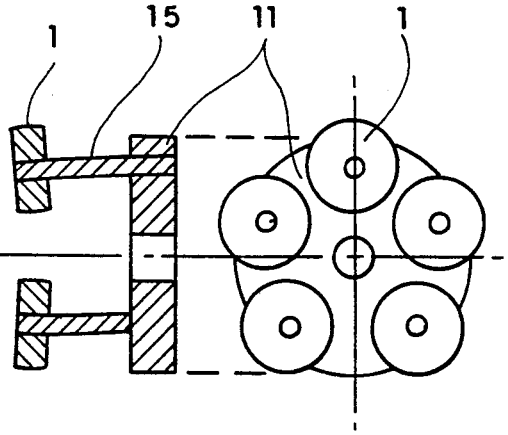
FIG. 2*b* is a longitudinal sectional view and a plan view of a piston rotor of the axial piston engine of FIG. 2.

The driving mechanism consists of a plurality of pistons 1, piston rods 15, and a piston carrier 11 forming the piston rotor of FIG. 2*b*, which corresponds to the invention being a single integral piece, free of bearings, and fixed to a shaft 3. The momentary axis of rotation is fixed in space and fixed with respect to a body. The cylinder drum 50 and the piston rotor 11 are also shown in detail in FIGS. 2*a* and 2*b*. In the embodiment shown in FIG. 2, the transverse deflection of the connecting rods 15 and thus, of the piston 1 is in the range of tenths of a millimeter. Such a small deflection will not affect suitable materials even at a permanent load. The configuration of FIG. 2 is the result of a variation problem to minimize all displacements. Under others, the shifts have a minimum when both axes of rotation D1 and D2 intersect in the center of the stroke. Simultaneously, the "eccentricity in the stroke area" has a minimum. The theory to these problems seems a little complicated, but the practical solution is very simple: The cylinder rotor will adjust automatically by the elasticity of the piston rods in the position of lowest displacement. The cylinder rotor does not need to be aligned independently with respect to its axis.

At the induction side, the expanding working space 5 is being filled through the inlet port 6*a* and the connecting rods 15 are being subjected to tensile forces since the conveying pressure usually prevails in the casing 7. The conveying pressure prevails automatically because the pressure side of the cylinder drum 50 loosely slides along the control surface 10 while the induction side of the cylinder drum 50 presses against the control surface 10. The pressure within the casing 7 is a result of the lacking counterpressure in correspondence with the size and quality of the sealing edge as illustrated by a broken line in FIG. 2*a*. During the discharge, which occurs at the pressure side of the cylinder drum 50 through the outlet port 6*b*, the pistons 1 perform almost no work and the piston rods 15 are not subjected to pressure and thus, cannot buckle. During normal operation, the cylinder drum 50 does not require any mounting or centering. Nevertheless, FIG. 2 shows a screw 30 for mounting the cylinder drum 50 to the control surface 10. The screw 30 and the slanted casing portion 31 ensure a proper start of the engine as well as protect the engine in problem situations. Thus, it is ensured that the cylinder drum 50 bears against the control surface 10 of the casing 7 during start and during occurrences of malfunctions. Although not shown, support rings may be provided at the flanks of the cylinders 2 to ensure that the cylinders 2 do not lift off the control surface 10 during disturbances such as a piston sticking to a cylinder wall. But all this is not necessary under normal operating conditions.

The axial piston engine illustrated in FIG. 2 is suitable as a powerful, high efficiency, noiseless pump for all pumpable medium. A respectively larger variant is applicable as either an oil-free high-pressure water pump, an oil-free motor, or an oil-free compressor. Centrifugal forces upon the piston at any speed can be compensated for by the slight bending of the piston rods 15 inwardly prior to installation as shown in FIG. 2*b*.

Upon use as oil-free compressor, the casing may be acted upon by water pressure with the water pressure slightly exceeding the conveying pressure of the gas and with the volume changes in the casing being slight. Thus, all gaps are sealed and the compressed gas is directly cooled. The aggregate can automatically generate a circulation of water under pressure by internally arranging a ring with a piston of a smaller diameter as a pump and with a larger diameter piston as a compressor or a combination of a motor and a pump.

It will be appreciated that this is certainly true for other embodiments. Generally, all embodiments can be combined with each other. For example, the transverse elastic piston carrier can be modified independent of other variations, as can be seen from FIG. 3 which shows a different piston carrier including tubular members 17 concentrically fitting into each other and being alternately connected at the ends thereof. A carrier of this type may transmit higher thrust forces in both directions.

Figure 4:
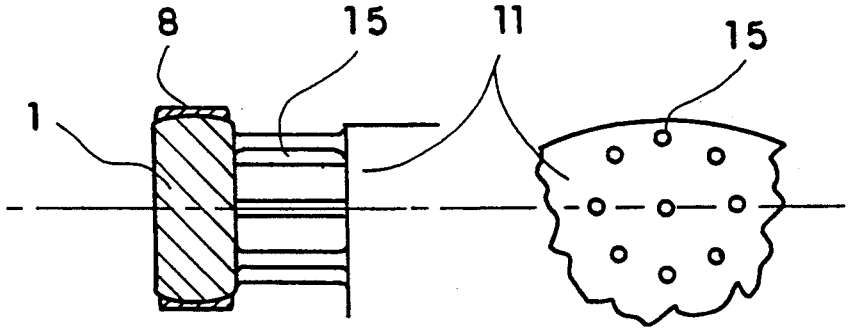
FIG. 4 is a sectional view and a plan view of a transverse elastic piston carrier comprising several rods.

FIG. 4 further shows a transverse elastic piston carrier with several parallel slender rods 15 connected to and supporting the piston 1. The piston 1 connected via the rods 15 may shift laterally by small amounts. When using an increased number of thinner rods, the ratio between transmittable longitudinal forces and slight lateral deflection is enhanced like, for example, when using a bundle of glass fibers or the like. It should be understood that the number of rods, as shown in FIG. 4, is small and is merely a symbolical depiction for illustrative purposes.

These driving mechanism parts can be used basically in all machines for the conversion of a relative stroke motion system to a rotating system of rotating movement. The principle is always the same. The piston 1, piston carrier 11, and shaft 3 are integrally joined together to form a driving mechanism which is of unitary construction and free of bearings. When several pistons are present, as in a multi-cylinder engine, each piston is fastened to permit lateral movement, whereby one piston, such as in a single-cylinder engine, can be rigidly fastened.

FIG. 4 shows a piston seal, like a spherical bearing, but with a thin wall. With a thin wall, the hydraulic forces need not be unnecessarily high. When a suitable material is used for the seal, for example a synthetic material, it works like a piston ring and should be the only interchangeable part.

Figure 5:
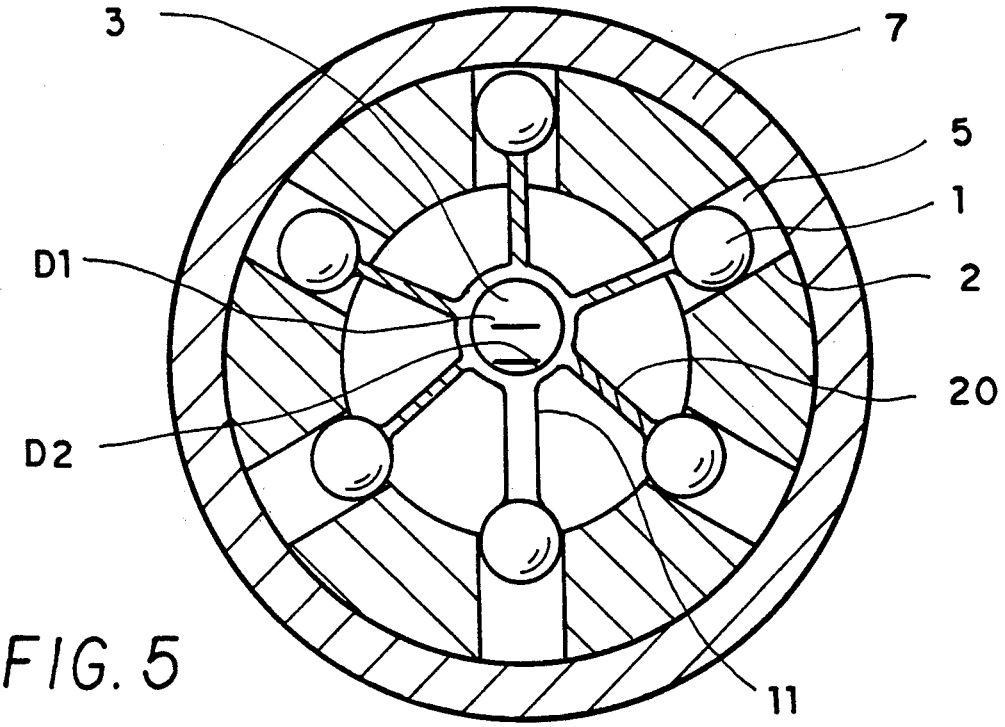
FIG. 5 is a sectional view of a radial piston engine having a piston carrier wherein the pistons are joined to ropes.

FIG. 5 shows a radial piston machine with flexible ropes. The radial pistons 1 are connected to the piston carrier 11 shaft 3 via the bundle of fibers or ropes 20. The piston carrier 11 is only the end portion of the shaft 3. One piston can be connected rigidly as in the embodiment shown in FIG. 7. During the operation of the piston engine, the conveying pressure and the centrifugal forces tighten, subjecting the ropes 20 to tensile forces only. The high flexibility of the ropes 20 allow the creation of a considerable stroke in a simple manner. Also, the pistons may be shaped in various configurations such as balls, radial directed cylinders, or transverse cylinders as well as other elongated shapes.

Figure 6:
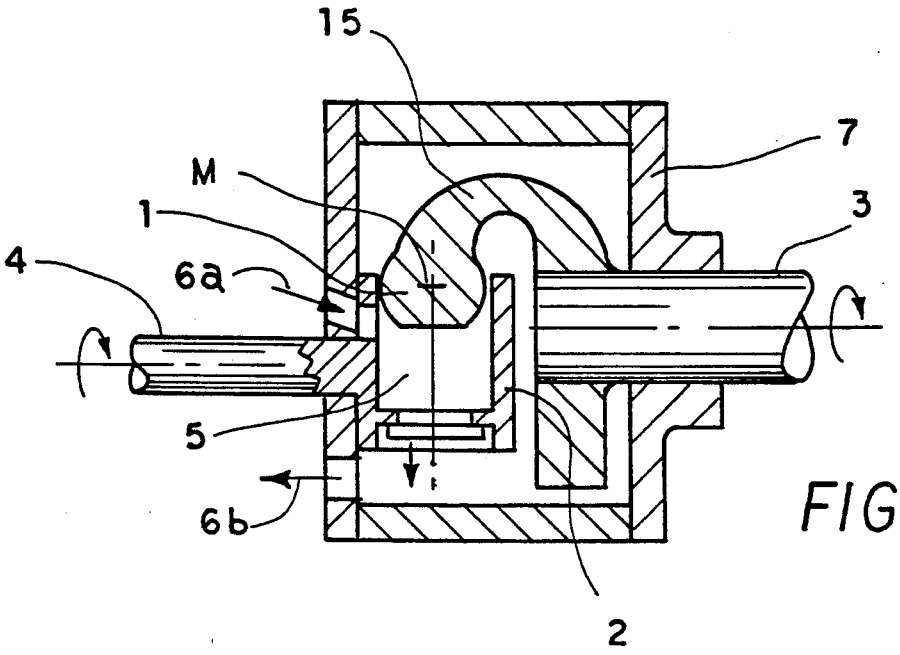
FIG. 6 is a sectional view of a radial single-cylinder engine with an inwardly directed piston.

Turning now to FIG. 6, there is shown a single-cylinder engine in which the piston 1 is securely mounted via a rigid bent piston rod 15 on the shaft 3 and the cylinder 2 is securely mounted on the shaft 4. Both shafts 3,4 are cantilevered. The shafts 3 extend into the interior of the casing 7 short of the cylinder 2. The connecting piston rod 15 is inwardly curved so that the piston 1 projects radially inwardly into the cylinder 2. It will be appreciated that the center M of the piston 1 does not extend precisely through one of the axes of rotation D1 or D2. If the center M of the piston did extend through one of the axes of rotation D1 or D2, no torque could be transmitted. Every rotor is balanced, hence providing a vibration-free machine.

Figure 3:
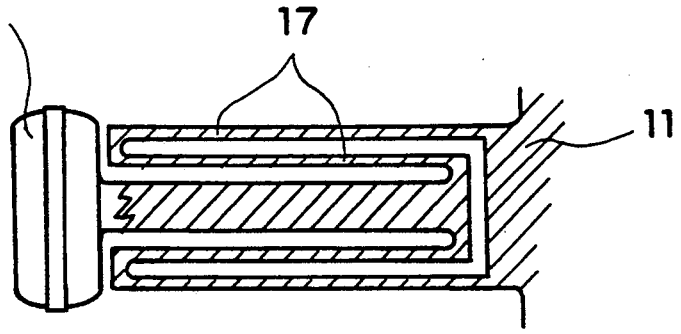
FIG. 3 is a sectional view of a crosswise elastic piston rod the driving mechanism.

The single-cylinder engine of this type attains a high sealing action because the high-pressure part includes only the piston seal as do, for example, FIGS. 3 or 4, and the outlet port **6*b* is controlled by a check valve 12. Thus, the casing 7 is filled with conveying pressure. The inlet port 6*a*** is laterally controlled through slots in the vicinity of the lower dead center, and thus is controlled at low pressure when being used in a compressor.

Figure 7:
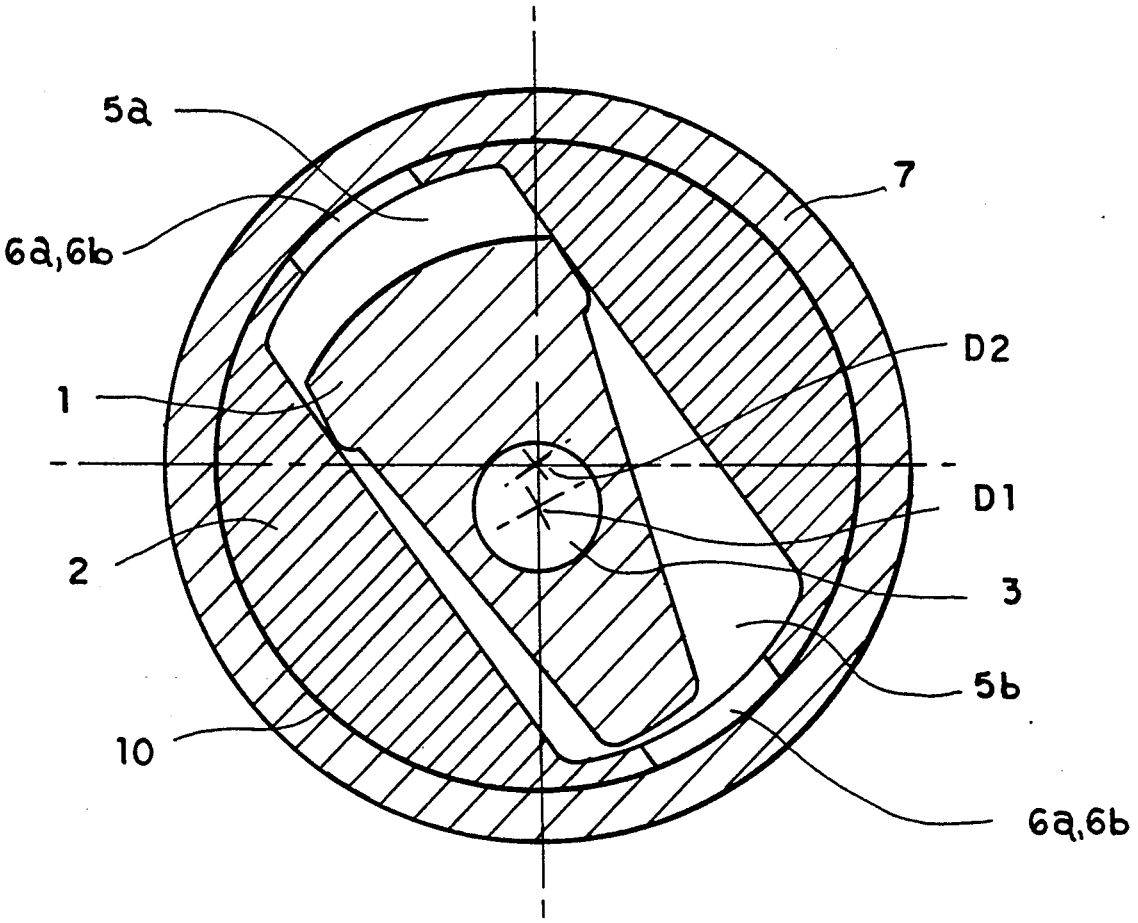
FIG. 7 is a modified radial single-cylinder engine with an outwardly directed piston.

Turning now to FIG. 7, there is shown a radial single-cylinder engine which is derived from the embodiment as shown in FIG. 6. This is similar to FIG. 6 with the exception of the change in the direction of the piston from inside to outside. Simultaneously, this embodiment is similar to that shown in FIG. 1, the single cylinder rotating machine, only with a change in the direction of the piston 1 from axial to radial. In the radial configuration, the adjustment is horizontally directed. This is not the case for the axial configuration. It is very important to show that only one coordinate need to be adjusted regardless of the configuration, whether axial or radial, or whether a single-cylinder or a multi-cylinder. This is the proof that the principles of this invention can be extended and uniformly applied to any configuration. This example includes a cylindrical casing 7 with a cylindrical control surface 10. The cylinder 2 occupies the entire interior of the casing 7 and defines a working space which is divided by the spherical piston 1 into two working spaces **5*a* and 5*b*, with the second working space 5*b* including a dead volume. A radial single-cylinder engine of this type does not require any valves as there are no spaces between cylinders which could cause intercommunication. The piston 1 is rigidly connected to the shaft 3 and rotates about the axis of rotation D1. The cylinder rotates about the axis of rotation D2 which is also the axis of symmetry of the casing 7. Both axes of rotation D1 and D2 are fixed in space and fixed with respect to a body, only their angular velocities do not always coincide. At its opposing ends, the cylinder 2 is open to accommodate an inlet and an outlet port 6*a*,6*b*. The stationary channels in the control surface 10** are disposed in a manner similar to that of a conventional radial piston machine and therefore, are not shown in detail.

The volumetric efficiency of the working space 5 is increased by the centrifugal force when the fluid comes from the inside. By pressurizing the casing 7, as shown in FIG. 5, the elastic parts are subjected primarily to tensile forces. In radial piston machines, the third dimension is free so that the pistons 1 and the cylinders 2 may also be elongated. Still, the same sectional view as shown in FIG. 7 applies. The spherical pistons 1 may be provided in all configurations with the spherical piston seal 8 as illustrated in FIG. 4.

It is to be understood that the present invention is not limited to the embodiments described above, but encompasses any and all embodiments within the scope of the following claims.

I claim:

1. A rotary piston machine having at least one bearingless piston connecting member and incorporating a relative stroke motion within a rotating system, said rotary piston machine comprising:

a) a cylinder drum including at least one cylinder, said at least one cylinder having an interior cylinder wall and a cross-sectional area bounded by said interior cylinder wall;

b) a piston rotor being of unitary construction and including at least one piston connected to a piston connecting member, said at least one piston having a cross-section substantially equivalent to said cross-sectional area of said at least one cylinder, whereby the relative stroke motion is created by a sweep of said piston along said interior cylinder wall, the relative stroke motion having a length equal to the sweep of said at least one piston, the sweep of said at least one piston further occurs along a figure axis which exists along an axis of symmetry of said at least one cylinder and intersects a center of said at least one piston, thus said figure axis is also equivalent to the length of the relative stroke motion;

c) said piston rotor and said cylinder drum each rotate on separate axes of rotation being fixed relative to one another such that said at least one piston engages with said at least one cylinder to form a piston and cylinders pair, whereby said at least one piston and said at least one cylinder revolve in a same direction and at a same rate about separate orbits to produce a periodic change in distance between any two fixed points, one of the fixed points being associated with said at least one piston and the other of the fixed points being associated with said at least one cylinder, the periodic change in distance is equivalent to the length of the relative stroke motion; and d) a casing for containing said cylinder drum and said piston rotor such that the axis of rotation of said cylinder drum is not aligned with the axis of rotation of said piston rotor and each of the axes of rotation remain constant relative to each other, whereby a revolution of the piston and cylinder pair results in an oscillating motion of said at least one piston within said at least one cylinder along the figure axis filling said at least one cylinder through an inlet port during an induction stage of the relative stroke motion and discharging said at least one cylinder through an outlet port during a compression stage of the relative stroke motion.

2. The rotary piston machine according to claim 1, wherein said casing comprises a control surface and a means for retaining said cylinder drum against said control surface and wherein said cylinder drum further includes means for providing a seal between said control surface and cylinder.

3. The rotary piston machine according to claim 1, wherein said at least one piston is rigidly connected to said piston connecting member and wherein said piston connecting member includes means for minimizing unwanted crosswise movement of said at least one piston against the relative stroke motion.

4. The rotary piston machine according to claim 1, wherein said piston connecting member is elastic crosswise at right angles to the relative stroke motion and along the relative stroke motion, thus enabling said at least one piston to be pivotal within said at least one cylinder.

5. The rotary piston machine according to claim 2, wherein said retaining means includes a fastening member axially insertable through said cylinder drum along the axis of rotation of said cylinder drum, said fastening member being engagable with said casing such that said cylinder drum is loosely secured adjacent said control surface.

6. The rotary piston machine according to claim 1, wherein said at least one piston includes means to provide a laterally shiftable seal between said at least one piston and said interior cylinder wall of said at least one cylinder wall to enable lateral mobility of said laterally shiftable seal, thereby minimizing unwanted crosswise movement of said at least one piston against the relative stroke motion to follow said at least one cylinder.

7. The rotary piston machine according to claim 1, wherein said piston connecting member includes a plurality of concentric tubular members joined at alternative ends to minimize unwanted crosswise movement of said at least one piston against the relative stroke motion.

8. The rotary piston machine according to claim 1, wherein said piston connecting member is comprised of a plurality of rods, whereby an increase in a quantity of said plurality of rods and a decrease in a cross-section of each one of said plurality of rods produces an increase in a ratio between a transmittable longitudinal force and a lateral deflection.

9. The rotary piston machine according to claim 1, wherein said interior cylinder walls are turned out in a spherical shell-shaped manner adjacent said control surface to control dead volume.

10. The rotary piston machine according to claim 1, wherein each piston is semi-spherical and includes a pivotal seal, said pivotal seal being a substantially thin ring which has a semi-spherical inner surface to conform to said semi-spherical piston and a cylindrical surface to conform with said cylinder.

11. The rotary piston machine according to claim 10, wherein each interior cylinder wall is turned out in a spherical shell-shaped manner adjacent said control surface to minimize dead volume.

12. A rotary piston machine having a plurality of bearing-free piston connecting members and incorporating a relative stroke motion within a rotating system, said rotary piston machine comprising:

a) a cylinder drum including a plurality of cylinders, each cylinder having an interior cylinder wall and cross-sectional area bounded by said interior cylinder wall;

b) a piston rotor being of unitary construction and including a plurality of pistons, each piston being connected to a piston carrier by a respective piston connecting member, each piston further having a cross-section substantially equivalent to the cross-sectional area of each respective cylinder, and whereby the relative stroke motion is created by a sweep of each respective piston along said interior cylinder wall of each respective cylinder, the relative stroke motion having a length equivalent to the sweep of each respective piston, said sweep of piston further occurring along a figure axis which exists along an axis of symmetry of said cylinder and intersects a center of said piston, said figure axis thus also being equivalent to said length of said stroke of motion;

c) said piston rotor and said cylinder drum each rotate on separate axes of rotation, said axes of rotation being fixed relative to one another such that each piston engages a respective cylinder to form a plurality of piston and cylinder pairs, and whereby said plurality of pistons and said plurality of cylinders revolve in a same direction and at a same rate about separate orbits to produce a periodic change in distance between any two fixed points, one of the fixed points being associated with each piston and the other of said fixed points being associated with each respective cylinder of each respective piston and cylinder pair, the periodic change in distance is equivalent to the length of the relative stroke motion; and d) a casing for containing said cylinder drum and said piston rotor such that the axis of rotation of said cylinder drum is not aligned with the axis of rotation of said piston rotor and each of the axes of rotation remain constant relative to each other, and whereby a revolution of each piston and cylinder pair results in an oscillating motion of each piston within each respective cylinder along each respective figure axis filling each respective cylinder through an inlet port during a induction stage of the relative stroke motion and discharging each respective cylinder through an outlet port.

13. The rotary piston machine according to claim 12, wherein each piston connecting member is comprised of a plurality of concentric tubular members joined at alternative ends in a serial arrangement so as to form a serpentine cross-section to minimized unwanted crosswise movement of each respective piston against the relative stroke motion.

14. The rotary piston machine according to claim 12, wherein each piston connecting member is comprised of a rope whereby a centrifugal force produced by a turning motion of said piston carrier tightens said rope.

15. The rotary piston machine according to claim 12, wherein each piston connecting member is comprised of a plurality of rods, whereby an increase in a quantity of said rods and a decrease in a cross-section of each one of said rods produces an increase in a ratio between a transmittable longitudinal force and a lateral deflection.

16. The rotary piston machine according to claim 12, wherein each piston includes means for providing a laterally shiftable seal relative to each piston and said interior cylinder wall of each respective cylinder to provide lateral mobility of said laterally shiftable seal, thereby minimizing unwanted crosswise movement of each respective piston against the relative stroke motion.

17. The rotary piston machine according to claim 1, wherein said casing comprises a control surface and means for retaining said cylinder drum against said control surface and wherein said cylinder drum further includes means for providing a seal between said control surface and cylinder.

18. The rotary piston machine according to claim 1, wherein each piston connecting member is elastic crosswise at right angles to the relative stroke motion and along the relative stroke motion.

19. A rotary piston machine having a bearing free drive actuation mechanism for moving at least one piston within at least one cylinder forming at least one piston and cylinder pair to execute a stroke motion of said at least one piston relative to said at least one cylinder within a rotating system:

at least one pressure tight work chamber located within each of said at least one piston and cylinder pairs, wherein each of said at least one piston therein is pivotable within each of said at least one cylinder;

each of said at least one cylinder being located within a single-piece cylinder rotor and each rotating within an orbit at a predetermined angular speed;

each of said piston rotating at substantially the same predetermined angular speed with the center of each of said piston remaining along a central axial line of each of said at least one cylinder belonging to the same piston and cylinder pair, but each of said at least one piston also rotating about an orbit within said rotating system which is substantially the same as but not identical to said orbit of each of said at least one cylinder;

whereby the difference in the orbits create an oscillation within the rotating system used to execute said stroke motion of each of said at least one piston, and the length of said stroke motion being a predetermined fraction of the diameter of selectively one of said orbits.

* * * * *